United States Patent [19]

Hochanadel

[11] 3,934,498

[45] Jan. 27, 1976

[54] COMPACTER FOR COMPACTING OBJECTS SUCH AS CANS AND THE LIKE

[76] Inventor: Donald L. Hochanadel, 9704 N. Georgia Ave., Oklahoma City, Okla. 73120

[22] Filed: Jan. 31, 1974

[21] Appl. No.: 438,448

[52] U.S. Cl. ..... 100/35; 100/DIG. 2; 100/238; 100/244; 100/266; 100/278; 100/293

[51] Int. Cl.[2] ..... B30B 7/04

[58] Field of Search ..... 100/244, 42, 52, 223, 233, 100/238, 244, 266, 291–292, 293, 295, DIG. 2, 35, 278

[56] References Cited

UNITED STATES PATENTS

| | | | |
|---|---|---|---|
| 310,336 | 1/1885 | Unger | 100/238 X |
| 968,848 | 8/1910 | Himebaugh | 100/238 X |
| 1,715,680 | 6/1929 | Shepherd et al. | 100/266 X |
| 2,238,571 | 4/1941 | Scott | 100/266 X |
| 3,024,720 | 3/1962 | Welsh | 100/DIG. 2 X |
| 3,253,537 | 5/1966 | Porter et al. | 100/238 X |
| 3,416,439 | 12/1968 | Tezuka | 100/223 |
| 3,461,821 | 8/1969 | Gallus | 100/238 X |
| 3,580,167 | 5/1971 | Simshauser | 100/52 |

*Primary Examiner*—Edward L. Roberts
*Assistant Examiner*—Arthur F. Henderson
*Attorney, Agent, or Firm*—Dunlap & Codding

[57] ABSTRACT

An improved compacter for flattening or compacting metal cans and the like wherein the can is initially positioned between a pair of spaced gripping members, the gripping members being subsequently moved toward each other compacting the can disposed therebetween. The gripping members grippingly engage the can and secure the can in a stationary position with respect to each of the gripping members and one of the gripping members is initially rotated as the gripping members are moved toward each other thereby twisting and weakening the structural integrity of the can to facilitate the compacting thereof.

16 Claims, 6 Drawing Figures

COMPACTER FOR COMPACTING OBJECTS SUCH AS CANS AND THE LIKE

BACKGROUND OF THE INVENTION

1. Field of the Invention

The present invention relates generally to an improved compacter and, more particularly, but not by way of limitation, to an improved compacter wherein the object to be compacted is twisted during the compacting thereof.

2. Brief Description of the Prior Art

In the past, various container flattening or compacting devices have been constructed for flattening metal cans or the like, such as a soft drink or a beer can, for example. One such device was shown in the U.S. Pat. No. 2,638,957, issued to Danielson, which disclosed a hand-operated can crusher for crushing cans such as oil cans, for example. The can crusher disclosed in the Danielson patent included a pair of plates and an angle member was formed on each of the plates, the angle members initially engaging the can and enhancing the crushing action as the plates were moved toward each other flattening the can therebetween.

The U.S. Pat. No. 2,800,160, issued to Wilson, disclosed a can flattening device having two plates hinged together for flattening a can-like member therebetween. The U.S. Pat. No. 3,416,439, issued to Tezuka, disclosed a hydraulically operated metal compressor having an upper element which was rotated during one aspect of the crushing operation, the rotation of the element moving certain protrusions to different positions for engaging selected portions of the metal during the crushing stroke of the metal compressor.

The U.S. Pat. No. 3,580,167, disclosed a motor-operated can crusher, and the U.S. Pat. No. 3,732,804, issued to Moller, disclosed a can compacter wherein portions of the can near the top and the bottom were initially depressed by plungers and one plate was subsequently moved toward the other effecting the crushing action.

Other can flattening or crushing devices were disclosed in the U.S. Pat. Nos. 2,905,079, issued to Brock; 3,011,429, issued to Kuslich; 3,043,212, issued to Hasselquist; 3,299,802, issued to Black; 3,411,722, issued to Webber; and 3,667,386, issued to Workman.

SUMMARY OF THE INVENTION

An object of the invention is to provide an improved compacter for flattening or compacting metal cans or the like wherein the structural integrity of the object to be compacted is weakened during the initial portion of the compacting stroke.

Another object of the invention is to provide an improved compacter for compacting metal cans and the like wherein the object is compacted or flattened in a manner requiring less force or effort.

One other object of the invention is to provide an improved compacter which can be utilized in cooperation with existing can opener mechanisms to provide a more economical and more efficient integrated can opener-can compacter assembly. A still further object of the invention is to provide a can compacter which is more economical in the construction and the operation thereof.

Other objects and advantages of the invention will be evident from the following detailed description when read in conjunction with the accompanying drawings which illustrated various embodiments of the invention.

BRIEF DESCRIPTION OF THE DRAWINGS

FIG. 6 is a diagrammatic, schematic view of still another modified compacter, connected and operating in cooperation with a can opener mechanism.

DESCRIPTION OF THE PREFERRED EMBODIMENTS

Figure 1:
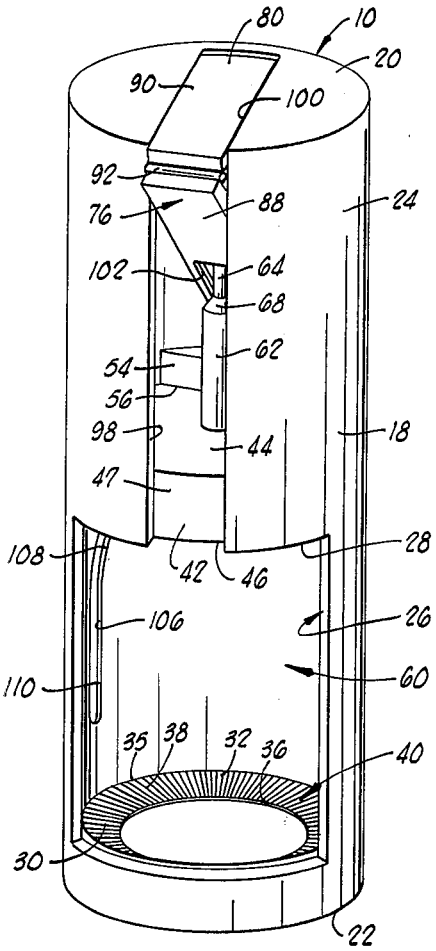
FIG. 1 is a perspective view of a compacter constructed in accordance with the present invention.
Figure 2:
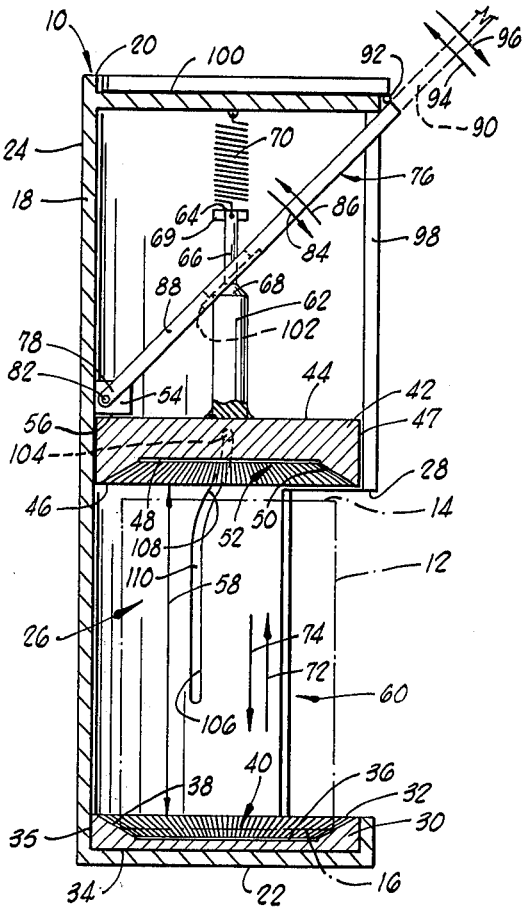
FIG. 2 is a cross sectional view of the compacter of FIG. 1.

Referring to the drawings in general and to FIGS. 1 and 2 in particular, shown therein and designated via the general reference numeral 10 is a can compacter constructed to collapsingly compact cylindrically shaped metal cans of the type commonly utilized to contain various liquid drinks such as soft drinks or beer or the like, a can being shown in dashed-lines in FIG. 2 and designated via the reference numeral 12. The can 12 has a top 14 and a bottom 16 andd the compacter 10 is particularly constructed to substantially flatten the can 12, the compacter 10 twisting the can 12 about the can center line axis extending generally between the top 14 and the bottom 16 as the can 12 is compactingly flattened in a manner to be described in greater detail below.

The compacter 10 includes a cylindrically shaped housing 18 having an upper end 20, a lower end 22 and an outer peripheral surface or wall 24. A chamber 26 is formed in the housing 18 extending generally between the upper end 20 and the lower end 22, and a can receiving opening 28 is formed through the wall 24 intersecting the chamber 26, the can receiving opening 28 being disposed generally near the lower end 22 and extending a distance generally toward the upper end 20. The can receiving opening 28 is sized to receive the can 12 during the operation of the compacter 10.

A cylindrically shaped lower gripping member 30 is disposed in the chamber 26 generally near the lower end 22, the lower gripping member 30 having an upper face 32, a lower face 34, and an outer peripheral surface 35. The lower face 34 is disposed near the lower end 22 of the housing 18 and the lower gripping member 30 is secured to the housing 18 in a stationary position in the chamber 26. A recess 36 is formed in the upper face 32 of the lower gripping member 30 forming an annular wall 38 extending about a central portion of the lower gripping member 30. In a preferred form, the annular wall 38 is formed at an angle to the center line axis of the lower gripping member 30 and a knurled, gripping surface 40 is formed on the annular wall 38, thereby forming an annular, angularly extending gripping surface 40 in the lower gripping member 30 for reasons to be made more apparent below.

A cylindrically shaped upper gripping member 42 is disposed in the chamber 26 generally between the upper and the lower ends 20 and 22, the upper gripping member 42 having an upper face 44, a lower face 46 and an outer peripheral surface 47. The diameter of the upper gripping member 42 is less than the diameter of the chamber 26 and the upper gripping member 42 is slidingly disposed in the chamber 26, the outer peripheral surface 47 slidingly engaging the peripheral surface formed in the housing 18 via the chamber 26. A recess 48 is formed in the lower face 46 of the upper gripping member 42 forming an annular wall 50 extending about a central portion of the upper gripping member 42. In a preferred form, the annular wall 50 is formed at an angle to the center line axis of the upper gripping member 42 and a knurled, gripping surface 52 is formed on the annular wall 50, thereby forming an annular, angularly extending gripping surface 52 in the upper gripping member 42 for reasons to be made more apparent below.

A post 54 is disposed in the chamber 26 and one end of the post 54 is secured to the inner peripheral surface of the housing 18 formed via the chamber 26, the post 54 extending a distance from the housing 18 and having a portion forming a downwardly facing stop surface 56 in the chamber 26. The stop surface 56 is positioned in the chamber 26 to engage a portion of the upper gripping member 42 and limit the sliding movement of the upper gripping member 42 in a direction generally from the lower end 22 toward the upper end 20 of the housing 18, the upper gripping member 42 being shown in FIG. 2 engaging the stop surface 56 of the post 54.

The upper gripping member 42 is aligned with the lower gripping member 30 and the gripping surface 40 generally faces the gripping surface 52. In the start position, the upper gripping member 42 is engaged via the stop surface 56, and the upper gripping member 42 is spaced a distance 58 from the lower gripping member 30, the space between the lower and the upper gripping members 30 and 42 forming a can receiving space 60 in the start position of the compacter 10. The can receiving opening 28 in the housing 18 communicates with the can receiving space 60 so an object to be compacted such as a can is insertable through the can receiving opening 28 into the can receiving space 60 generally between the gripping surfaces 40 and 52 of the upper and the lower gripping members 42 and 30 for placing the can 12 in a compacting position wherein the can bottom 16 engages the gripping surface 40 of the lower gripping member 30 and the can top 14 engages the griping surface 52 of the upper gripping member 42. The gripping surfaces 40 and 52 engage the can and cooperate to secure the can in a substantially stationary position relative to the upper and the lower gripping members 42 and 30 as the can is simultaneously rotated or twisted during the compacting stroke of the compacter 10, in a manner and for reasons to be described in greater detail below.

One end of a cylindrically shaped rod 62 is secured to a central portion of the upper face 44 of the upper gripping member 42 and the rod 62 extends perpendicularly upwardly from the upper face 44 toward the housing 18 upper end 20 terminating with an upper end 64. A portion 66 of the rod 62 near the upper end 64 thereof has a smaller diameter as compared to the remaining portion of the rod 62 forming an annular ledge 68 between the upper end 64 and the end of the rod 62 secured to the upper gripping member 42. A flange 69 is formed on the upper end 64, for reasons to be made more apparent below.

One end of a return spring 70 is secured to the housing 18 upper end 20 and the opposite end of the return spring 70 is secured to the upper end 64 of the rod 62.

The return spring 70 biases the rod 62 and the upper gripping member 42 in a return direction 62, the upper gripping member 42 being slidingly moved in the chamber 26 in a compacting direction 74 via a handle 76 against the biasing force of the return spring 70 and slidingly moved in the return direction 72 to the start position via the return spring 70 in a manner to be made more apparent below.

The handle 76 has opposite ends 78 and 80 and the end 80 is moveably or pivotally secured to the post 54 at a pivot connection 82, the handle 76 being pivotally moveable in a first pivot direction 84 and a second pivot direction 86, as shown in FIG. 2. The handle 76 includes a first handle member 88 and a second handle member 90, one end of the second handle member 90 being hingedly connected to one end of the first handle member 88 via a hinge 92. The hinge 92 is positioned on one side of the first and the second handle members 88 and 90 such that the second handle member 90 is hingedly moveable in one direction 94 and in the opposite direction 96, the second handle member 90 being moveable in the direction 94 to a position wherein the ends of the first and the second handle members 88 and 90 abut and the first and the second handle members 88 and 90 are disposed in a substantially coplanar disposition, as shown in FIG. 2. The abutment of the ends of the first and the second handle members 88 and 90 limits the movement of the second handle member 90 in the direction 96 positioning the first and the second handle members 88 and 90 in the coplanar extending disposition. A handle opening 98 is formed through the outer periphery or wall 24 of the housing 18 intersecting and communicating with the chamber 26. The handle 76 is moveably disposed through the handle opening 98. One end of the handle opening 98 intersects the can receiving opening 28 and the handle opening 98 extends generally axially upwardly toward and terminates near the housing 18 upper end 20. The first handle member 88 is sized such that the handle 76 is moveable in the second pivot direction 86 to a position wherein a portion of the first handle member 88 near the end thereof, opposite the end pivotally connected to the post 54, engages a portion of the upper end 20 of the housing 18, and the engagement between the first handle member 88 and the upper end 20 of the housing 18 is generally near the hinge 92.

After the engagement between the first handle member 88 and the upper end 20 of the housing 18, the second handle member 90 is further moveable about the hinge 92 in the direction 94 to a position wherein the second handle member 90 is disposed generally adjacent the upper end 20 of the housing 18. In one preferred form, a handle recess 100 is formed in the upper end 20 of the housing 18 and is sized to receive the second handle member 90, the second handle member 90 being moveable in the direction 94 to a position wherein the second handle member 90 is storingly disposed within the handle recess 100. In the stored position of the second handle member 90 in the handle recess 100, the upper surface of the second handle member 90 is disposed in a substantially coplanar disposition with the upper surface of the housing 18 upper end 20 and thus the handle 76 is particularly constructed to be stored in a nonobstructing, convenient position when the compacter 10 is not being operated to compact cans.

An elongated opening 102 is formed through the handle 76 and, more particularly, through and extending between the opposite ends of the first handle member 88. The smaller diameter portion 66 of the rod 62 is disposed through the opening 102 and a portion of the second handle member 90 near the opening 102 engages the ledge 68 formed on the rod 62. As the handle 76 is moved in the first pivot direction 84, the first handle member 88 engages the ledge 68 and moves the rod 62 in the compacting direction 74 thereby slidingly moving the upper gripping member 42 in the compacting direction 74, the portion 66 of the rod 62 moving within the opening 102 between the opposite ends of the first handle member 88 as the handle 76 is moved in the first and the second pivot directions 84 and 86 during the operation of the compacter 10.

The flange 69 is sized to engage portions of the first handle member 88 generally adjacent the opening 102 and prevent the movement of the rod 62 through the opening 102 in one direction. In the event the return spring 70 breaks, the engagement between the flange 69 and the handle 76 prevents the downward movement of the upper gripping member 42 and cooperates to maintain the connection between the rod 62 and the handle 76.

A cam projection 104 is secured to the outer peripheral surface 47 of the upper gripping member 42 and extends a distance generally radially therefrom. The end of the cam projection 104, opposite the end secured to the upper gripping member 42, is slidingly disposed in a cam recess 106 formed in a portion of the inner peripheral surface of the housing 18 formed via the chamber 26. As shown more clearly in FIG. 2, the cam recess 106 extends generally between the upper and the lower ends 20 and 22 of the housing 18, and an upper curved portion 108 of the cam recess 106 is formed along a curved path, a lower, substantially straight portion 110 of the cam recess 106 extending in a generally straight, axial direction along the housing 18.

The cam recess 106 forms a guide path guiding the upper gripping member 42 via the cam projection 104 connected thereto along a predetermined path of travel as the upper gripping member 42 is slidingly moved in the chamber 26 in the compacting direction 74 and in the return direction 72. The upper curved portion 108 of the cam recess 106 guides the cam projection 104 along a curved path rotating the upper gripping member 42 as the upper gripping member 42 is moved in the compacting direction 74 from the start position when the upper griping member 42 is engaged via the stop surface 56 of the post 54 toward the lower end 22 of the housing 18. After the upper gripping member 42 has been rotated following a path of travel defined via the cam projection 104 and the cam recess 106, the path of travel of the upper gripping member 42 is defined via the substantially straight portion 110 of the cam recess 106 and the upper gripping member 42 is thus slidingly moved in the compacting direction 74 generally along a straight or axial path of travel.

The initial rotation of the upper gripping member 42 defined via the curved portion 108 of the cam recess 106 causes the object to be compacted or the can to be initially twisted as the can is being compacted via closing the distance between the upper and the lower gripping members 42 and 30. It has been found that the initial rotation of the upper gripping member 42 resulting in the initial rotating or twisting of the can during the compacting thereof facilitates the compacting of the can and results in a decreased amount of energy being required for the compacting of the can. In a preferred form, it has been found preferable to initially rotate the upper gripping member 42 thereby twisting the can to be compacted via an amount less than ninety degrees, and preferably less than 45°. The initial rotation of the upper gripping member 42 and the resulting initial twisting of the can to be compacted functions to weaken the structural integrity of the can and facilitate the compacting of the can in a manner which requires less energy and the can is compacted in a faster and more convenient manner.

It should be noted that a spiral thread can be formed on the rod 62 and the rod 62 can then be threadedly disposed through a threaded opening formed through an extended portion of the post 54 in lieu of the cam projection 104 and cam recess 106. The threaded rod 62 and cooperating threaded opening function to rotate the upper gripping member 42 as the gripping member is moved in the compacting direction 74 via the handle 76 engaging the rod 62 in a manner described before.

OPERATIONS OF FIGS. 1 AND 2

In the initial or start position of the compacter 10, the second handle member 90 is disposed in the handle recess 100 formed in the housing 18 upper end 20 and the upper gripping member 42 is positioned adjacent and abutting the stop surface 56 of the post 54, the upper gripping member 42 being positioned a maximum distance from the lower gripping member 30 forming the can receiving space 60 between the upper and the lower gripping members 42 and 30. In this position, a can to be compacted is inserted through the can receiving opening 28 into the can receiving space 60 to a position wherein the lower end 16 of the can 12 is grippingly engaged via the gripping surface 40 of the lower gripping member 30 and the can top 14 is disposed generally below the gripping surface 52 of the upper gripping member 42, the can being positioned in the can receiving space 60 substantially as shown via the dashed-line can 12 in FIG. 2.

After the object or can to be compacted has been positioned in the can receiving space 60, the handle 76 is then moved to an operating position by first moving the second handle member 90 in the direction 96 to a position wherein the ends of the first and the second handle members 88 and 90 generally adjacent the hinge 92 engage positioning the first and the second handle members 88 and 90 in a substantially coplanar disposition, the second handle member 90 being moved to the coplanar disposition as indicated via the dashed-line segment of the second handle member 90 shown in FIG. 2. In this position, the handle 76 is supported in an angularly extending position via the engagement between the handle 76 and the ledge 68 of the rod 62, a portion of the handle 76 generally opposite the end pivotally connected to the post 54 extending through the upper portion of the handle opening 98 formed through the housing 18.

The handle 76 is then moved in the first pivot direction 84 thereby moving the upper gripping member 42 in the compacting direction 74 via the engagement between the handle 76 and the ledge 68 of the rod 62. As the upper gripping member 42 is slidingly moved in the compacting direction 74, the gripping surface 52 of the upper gripping member 42 is moved into gripping engagement with the can top 14. Further, as the upper gripping member 42 is slidingly moved in the compacting direction 74 via the handle 76, the cam projection 104 is guided along the curved portion 108 of the cam recess 106 thereby rotating the upper gripping member 42 about a rotational axis substantially corresponding to the axial center line of the housing 18 chamber 26. The gripping engagement between the upper gripping member 42 gripping surface 52 and the can top 14 and between the lower gripping member 30 gripping surface 40 and the can bottom 16 secures the can and prevents rotation of the can about the can center line axis relative to the upper and the lower gripping members 42 and 30 while the upper gripping member 42 is moved in the compacting direction 74 toward the lower gripping member 30 thereby compacting or flattening the can 12.

Since the rotation of the can 12 relative to the upper and the lower gripping members 42 and 30 is substantially prevented via the gripping engagement between the can 12 and the gripping surfaces 52 and 40, the can 12 is twisted about the can center line axis as the upper gripping member 42 is rotated via the movement of the cam projection 104 within the curved portion 108 of the cam recess 106. As mentioned before, the curved portion 108 of the cam recess 106 is disposed generally near the upper end of the cam recess 106 and thus the can 12 is twisted about the can center line axis during the initial portion of the compacting stroke, the cam projection 104 being subsequently guided into and through the straight portion 110 of the cam recess 106 as the upper gripping member 42 is moved further in the compacting direction 74 to a position wherein the upper gripping member 42 is disposed generally near the lower gripping member 30 and the can 12 is substantially compacted or flattened generally between the upper and the lower gripping members 42 and 30.

After the handle 76 has been moved in the compacting direction 74 to a position wherein the can is substantially flattened or compacted between the upper and the lower gripping members 42 and 30, the handle 76 is released and the upper gripping member 42 is biasingly pulled in the return direction 72 via the return spring 70. The upper gripping member 42 is slidingly moved in the return direction 74 via the biasing force of the return spring 70 to a position wherein the upper face 44 of the upper gripping member 42 engages a portion of the stop surface 56 of the post 54 thereby positioning the upper gripping member 42 in the predetermined start position within the housing 18 chamber 26. After the upper gripping member 42 has been repositioned in the start position, the compacted or flattened can is then removed from the can receiving space 60 via the can receiving opening 28 and the compacter 10 is thus positioned to receive and compact another can.

The elongated opening 102 formed in the handle 76 facilitates the movement of the reduced diameter portion 66 of the rod 62 generally within the opening 102 between the end of the handle 76 pivotally connected to the post 54 and the opposite end of the handle 76 as the handle 76 is moved in the first pivot direction 84 moving the upper gripping member 42 in the compacting direction 74 and as the handle 76 is moved in the second pivot direction 86 as the return spring 70 biasingly pulls the upper gripping member 42 in the return direction 72. The ledge 68 on the rod 62 is positioned to support the handle 76 in an angularly extending position such that the hinge 92 connection between the first and the second handle members 88 and 90 is disposed generally near the upper end 20 of the housing 18 in the start position of the upper gripping member 42, the handle 76 being thus positioned so that the second handle member 90 can be quickly and conveniently moved in the direction 94 to a storage position disposing the second handle member 90 generally within the handle recess 100 formed in the upper end 20 of the housing 18.

EMBODIMENTS OF FIGS. 3 AND 4

Figure 3:
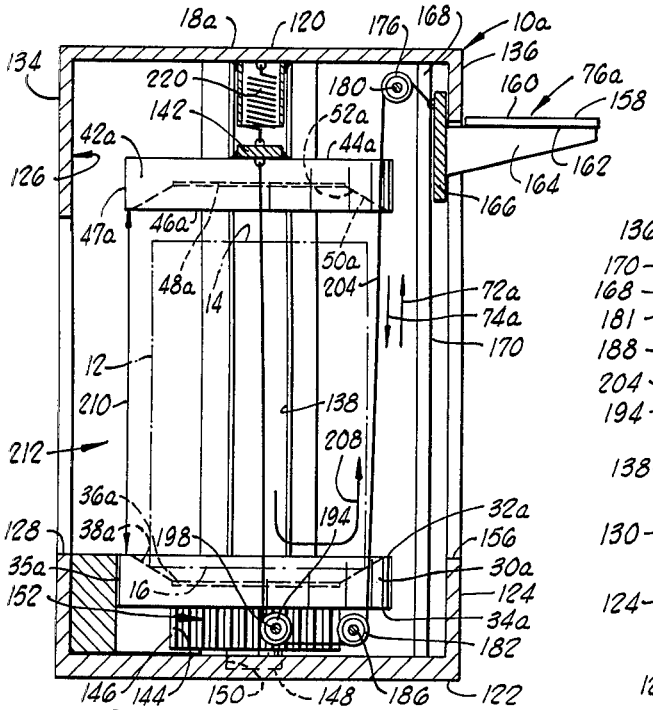
FIG. 3 is a cross sectional view, similar to FIG. 2, but showing a modified compacter.
Figure 4:
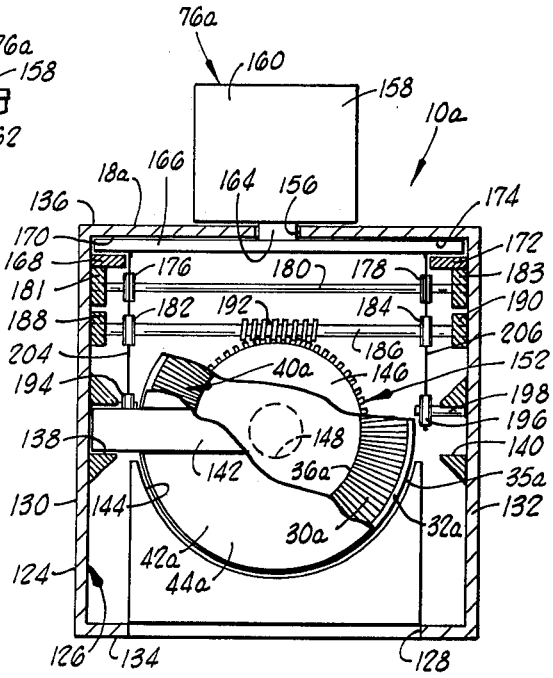
FIG. 4 is a sectional view of the modified compacter of FIG. 3.

Shown in FIGS. 3 and 4 is a modified compacter **10*a* having a modified housing 18*a* with a modified lower and upper gripping members 30*a* and 42*a* disposed in the housing 18*a* chamber 26*a*, the upper gripping member 42*a* being moveable in a return direction 72*a* and in a compacting direction 74*a* via a modified handle 76*a*. The compacter 10*a* is constructed such that the object to be compacted such as the can 12 shown in dashed lines in FIGS. 3 and 4 is rotated or twisted about the can's center line axis as the lower and the upper gripping members 30*a* and 42*a* are moved to a compacting position for reasons described before with respect to the compacter 10 (shown in FIGS. 1 and 2) and in a manner to be described in greater detail below with respect to the modified compacter 10*a***.

The housing **18*a* is constructed similar to the housing 18, described in detail before, and includes an upper end 120, lower end 122, an outer periphery or wall 124 and a chamber 126 formed therein and extending generally between the housing upper and lower ends 120 and 122. The housing 18*a* has a generally square-shaped cross section and a can receiving opening 128 is formed through a portion of the outer periphery 124, the can receiving opening 128 communicating with a portion of the chamber 126 and being positioned for receiving the objects to be compacted in a manner similar to that described before with respect to the housing 18 chamber 26 and the can receiving opening 28. More particularly, the housing 18*a* includes a first and a second side 130 and 132 and a front and a rear side 134 and 136, the can receiving opening 128 being more particularly formed through the front side 134**.

A first channel 138 is formed on the first side 130 and a second channel 140 is formed on the second side 132 the first channel 138 being disposed generally on a central portion of the first side 130 and extending generally between the upper and the lower ends 120 and 122 of the housing **18*a* and the second channel 140 being disposed generally on a central portion of the second side 132 and extending generally between the upper and the lower ends 120 and 122 of the housing 18*a*. The first channel 138 is aligned with the second channel 140 and the first and the second channels 138 and 140 are each disposed within a portion of the chamber 126 and extend axially through the chamber 126**, for reasons which will be made more apparent below.

A slide bar 142 is secured to a central portion of the upper face **44*a* of the upper gripping member 42*a*, the slide bar 142 extending diametrically across the upper face 44*a* and each of the opposite ends of the slide bar 142 extend a distance radially beyond the outer peripheral surface 47*a* of the upper gripping member 42*a*. One end of the slide bar 142 is slidingly disposed in the first channel 138 and the opposite ends of the slide bar 142 is slidingly disposed in the second channel 140, the slide bar 142 being thus slidingly retained within the first and the second channels 138 and 140 and the first and the second channels 138 and 140 cooperate with the slide bar 142 to prevent the upper gripping member 42***a* from rotating about the housing 18*a* center line axis as the upper gripping member 42*a* is moved in the compacting direction 74*a* and the return reduction direction 72*a* during the operation of the compacter 10*a*.

An annular recess 144 is formed in the lower end 122 of the housing 18*a* and the lower gripping member 30*a* is rotatingly disposed within the annular recess 144. A circularly shaped gear 146 is secured to a central portion of the lower face 34*a* of the lower gripping member 30*a* and a shaft 148 is secured to a central portion of the gear 146, the shaft 148 extending the distance radially from the gear 146 and being journally disposed in a shaft recess 150 formed in the lower end 122 of the housing 18*a*. A plurality of gear teeth 152 are formed on the outer periphery of the gear 146 forming the annular geared surface extending about the lower gripping member 30*a*.

A handle opening 156 is formed through the central portion of the rear side 136 of the housing 18*a* and the handle opening 156 extends generally axially between the upper and the lower ends 120 and 122 of the housing 18*a*. The handle 76*a*, more particularly, comprises a plate 158 having an upper plate face 160 and a lower plate face 162, a flange 164 being secured to a central portion of the lower plate face 162. One end of the flange 164 extends a distance beyond the plate 158 and is movably disposed generally within the handle opening 156 formed in the housing 18*a*. The end of the flange 164 extending through the handle opening 156 is secured to a slide member 166, to the plate 158 via the flange 164, the flange 164 being secured to a central portion of the slide member 166.

A rail 168 is secured to the first side 130 of the housing 28*a* and the rail 168 extends generally between the upper and the lower ends 120 and 122 of the housing 18*a*, the rail 168 being spaced a distance from the rear side 136 forming a first slide channel 170 disposed generally near the rear side 136 and the first side 130 of the housing 18*a*. Another rail 172 is secured to the second side 132 of the housing 18*a*, the rail 172 extending generally between the upper and the lower ends 120 and 122 of the housing 18*a*. The rail 172 extends a distance from generally perpendicularly from the second side 132 and is spaced a distance from the rear side 136 of the housing 18*a* forming a second side channel 174 disposed near the second side 132 and near the rear side 136 of the housing 18*a*.

The second slide channel 174 is aligned with the first slide channel 170, the first slide channel 170 being sized and disposed to slidingly receive one end of the slide member 166 and the second slide channel 174 being sized and disposed to slidingly receive the opposite end of the slide member 166. Thus, the slide member 166 is retained in a predetermined guide path via the first and second slide channels 170 and 174 and the slide member 166 is slidingly disposed in the first and the second slide channels 170 and 174 for sliding movement therein generally between the upper and the lower ends 120 and 122 of the housing 18*a*.

A pair of first guide pulley wheels 176 and 178 are secured to a shaft 180, one end of the shaft 180 being journally and rotatingly connected to the first side 130 via a bearing 181 and the opposite end of the shaft 180 being journally and rotatingly connected to the second side 132 via a bearing 183. The shaft 180 thus extends generally between the first and the second sides 130 and 132 and is disposed generally within the chamber 126 spaced a distance above the upper gripping member 42*a* and generally near the housing upper end 120. The first guide pulley wheels 176 and 178 are spaced apart a predetermined distance on the shaft 180, the first guide pulley wheel 176 being disposed generally on one side of the upper gripping member 42*a* and the other first guide pulley wheel 178 being disposed generally on the opposite side of the upper gripping member 42*a*.

A pair of second guide pulley wheels 182 and 184 are secured to a shaft 186, the shaft 186 being disposed generally near the lower end 122 of the housing 18*a*. More particularly, the shaft 186 is journally supported via a pair of bearings 188 and 190, the bearing 188 being secured to the first side 130 and journally supporting one end of the shaft 186 and the bearing 190 being secured to the second side 132 and journally supporting the opposide end of the shaft 186. The shaft 186 is, more particularly, disposed generally within the annular recess 144 formed in the housing 18*a* lower end 122 as shown more clearly in FIG. 3. A drive gear 192, which is preferably constructed in the form of a worm gear, as shown in FIG. 4, is secured to a central portion of the shaft 186 and the shaft 186 is disposed with respect to the circularly shaped gear 146 such that the drive gear 192 gearingly and drivingly engages the circularly shaped gear 146 as the shaft 186 is rotated during the operation of the compacter 10*a*.

A pair of third guide pulley wheels 194 and 196 are secured to a shaft 198, the third guide pulley wheels 194 and 196 being spaced apart a predetermined distance axially along the shaft 198, as shown more clearly in FIG. 4. One end of the shaft 198 is journally supported via a bearing (not shown) secured to the first side 130 of the housing 18*a* and the opposite end of the shaft 198 is journally supported via bearing (not shown) secured to the second side 132 of the housing 18*a*, the shaft 198 extending across and being journally supported within the housing chamber 126 near the housing lower end 122.

The first guide pulley wheel 176, the second guide pulley wheel 182 and the third guide pulley wheel 194 are each generally aligned within the chamber 126 and a cable 204 is disposed over each of the guide pulley wheels 176, 182 and 194. The first guide pulley wheel 178, the second guide pulley wheel 184 and the third guide pulley wheel 196 are also generally aligned and supported within the housing chamber 126 and a cable 206 is disposed generally over the guide pulley wheels 178, 184 and 196. One end of the cable 204 is secured to the slide member 166 and the opposite end of the cable 204 is secured to the slide bar 142 attached to the upper gripping member 42*a*, the cable 204 thereby connecting the handle 76*a* and the upper gripping member 42*a*. One end of the cable 206 is secured to the slide member 166 on the opposite end of the cable 206 secured to the slide bar 142, the cable 206 thereby connecting the handle 76*a* and the upper gripping member 42*a*.

The drive gear 192 is gearingly connected to the gear teeth 152 of the gear 146 on the lower gripping member 30*a* and the gear 192 thus drivingly rotates the gear 146 and lower gripping member 30*a* connected thereto in a driven position of the gear 192 wherein the shaft 186 is drivingly rotated. The cables 204 and 206 are each connected to the handle 76*a* and to the second guide pulley wheels 182 and 184 on the shaft 186 such that, when the handle 76*a* is slidingly moved in the compacting direction 74*a*, the cables 204 and 206 are each moved in the cable direction 208, as shown in FIG. 3 with respect to the cable 206. The movement of the cables 204 and 206 in the cable direction 208 drivingly rotates the shaft 186 via the connection between the cable 204 and the second guide pulley wheel 182 and the connection between the cable 206 and the second guide pulley wheel 184 thereby drivingly rotating the gear 192 causing the rotation of the lower gripping member 30*a* via the gearing connection between the gear 192 and the gear 146. Further, when the handle 76*a* is moved in the compacting direction 74*a*, the upper gripping member 42*a* is pulled in the compacting direction 74*a* due to the connection between the handle 76*a* and the upper gripping member 42*a* via the cables 204 and 206. Thus, the cables 204 and 206 are each connected between the handle 76*a*, the upper gripping member 42*a* and the lower gripping member 30*a* such that, when the handle 76*a* is moved in the compacting direction 74*a*, the upper gripping member 42*a* is pulled in the compacting direction 74*a* and the lower gripping member 42*a* is rotated via the gearing connection between the gears 192 and 146, the compacter 10*a* thus operating to compact the can and simultaneously cause the can to be rotated in a manner and for reasons similar to that described before with respect to the compacter 10.

One end of a return spring 220 is connected to the upper end 120 of the housing 18*a* and the opposite end of the return spring 220 is connected to the upper face 44*a* of the upper gripping member 42*a* or, more particularly, to the slide bar 142. The return spring 220 biases the upper gripping member 42*a* in the return direction 72*a*, and thus the handle 76*a* is moved in the compacting direction 74*a* against the biasing force of the return spring 220. After the object has been compacted, the return spring 220 biasingly pulls the upper gripping member 42*a* in the return direction 72*a* toward the start position.

OPERATION OF FIGS. 3 and 4

The compacter 10*a*, will operate to substantially compact or flatten an object such as a metal can or the like in a manner similar to that described before with respect to the compacter 10 (shown in FIGS. 1 and 2). In the initial or start position of the compacter 10*a*, as shown in FIGS. 3 and 4, the upper gripping member 42*a* is disposed generally near the upper end 120 of the housing 18*a* and spaced a predetermined distance 210 from the lower gripping member 30*a* thereby forming a can receiving space 212 generally between the upper and the lower gripping members 42*a* and 30*a*. The can receiving space 212 is generally aligned with the can receiving opening 128 formed through the housing 18*a*, in a manner and for reasons described before with respect to the can receiving space 60 and the can receiving opening 28. Further, in the initial or start position of the compacter 10*a*, the handle 76*a* is slidingly disposed within the first and the second slide channels 170 and 174 and positioned generally near the upper end 120 of the housing 18*a*.

In this start position of the compacter 10*a*, the object to be compacted is inserted through the can receiving opening 128 into the can receiving space 212 generally between the upper and the lower gripping members 42*a* and 30*a*. As shown in FIG. 3, the can 14 has been placed in the compacting position between the upper and the lower gripping members 42*a* and 30*a*, the bottom 16 of the can 14 being grippingly engaged via the gripping surface 40*a* formed on the lower gripping member 30*a*.

After the object to be compacted or the can has been placed in the initial compacting position between the upper and the lower gripping members 42*a* and 30*a*, the handle 76*a* is moved in the compacting direction 74*a* against the biasing force of the return spring 220, the handle 76*a* being slidingly retained via the first and the second slide channels 170 and 174 as the handle 76*a* is being moved in the compacting direction 74*a*. The movement of the handle 76*a* in the compacting direction 74*a* causes the upper gripping member 30*a* to be slidingly moved in the compacting direction 74*a* due to the connection between the handle 76*a* and the upper gripping member 42*a* formed via the cables 204 and 206. The ends of the slide bar 142 are slidingly disposed in the first and the second channels 138 and 140 and the slide bar 142 cooperates to retain the upper gripping member 42*a* in a predetermined path of travel as the upper gripping member 42*a* in a predetermined path of travel as the upper gripping member 42*a* is moved in the compacting direction 74*a*, the sliding connection between the slide bar 142 and the first and the second slide channels 138 and 140 also cooperating to prevent the rotation of the upper gripping member 42*a* in the chamber 126 during the movement of the upper gripping member 42*a* in the compacting direction 74*a*.

The upper gripping member 42*a* is thus moved into gripping engagement with the top 14 of the can 12 via the movement of the handle 76*a*, the top 14 of the can 12 being grippingly engaged via the gripping surface 52*a* of the upper gripping member 42*a*. After the initial gripping engagement between the top 14 of the can 12 and the gripping surface 52*a* of the upper gripping member 42*a*, the handle 76*a* is further moved in the compacting direction 74*a* thereby further moving the upper gripping member 42*a* in the compacting direction 74*a* and compacting the can 12 generally between the upper and the lower gripping members 42*a* and 30*a*. The gripping engagement between the bottom 16 of the can 12 and the gripping surface 40*a* of the lower gripping member 30*a* and the gripping engagement between the top 14 of the can 12 and the gripping surface 52*a* of the upper gripping member 42*a* prevents the rotation of the can 12 about the can center line axis relative to the upper and the lower gripping members 42*a* and 30*a* or, in other words, the ends 14 and 16 of the can 12 are each secured in a stationary position relative to one of the upper and the lower gripping members 42*a* and 30*a* via the gripping engagement therebetween.

As the handle 76*a* is moved in the compacting direction 74*a*, the shaft 186 is rotated via the cables 204 and 206 connected to the second guide pulley wheels 182 and 184, respectively, thereby rotating the lower gripping member 30*a* due to the gearing interconnection between the gear 192 and the gear 146 formed on the lower face 34*a* of the gripping member 30*a*. Since the bottom 16 of the can 12 is secured in a stationary position relative to the lower gripping member 30*a* via the gripping engagement between the gripping surface 40*a* and the bottom 16 of the can 12, the rotation of the lower gripping member 30*a* rotates the can 12 about the center line axis of the can thereby rotating or twisting the can about the can center line axis as the can is being compacted between the upper and the lower gripping members 42*a* and 30*a*. The twisting of the can 12 as can 12 is being compacted functions to weaken the structural integrity of the can and enhance and facilitate the compacting of the can in a manner described before with respect to the compacter 10.

The degree or amount of rotation of the lower gripping member 32*a* is primarily a function of the gear 192 and 146 and the size of the second guide pulley wheels 182 and 184. In a preferred form, the can is rotated approximately ten degrees about the can center line axis during the compacting thereof, the can being preferably rotated less than 45°, for reasons and in a manner described in detail before with respect to compacter 10*a*.

EMBODIMENT OF FIG. 5

Figure 5:
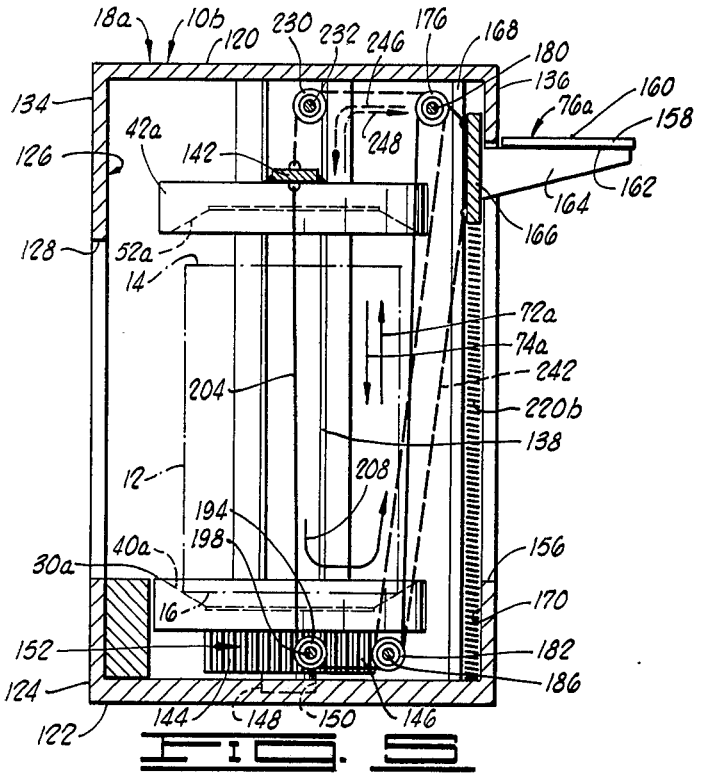
FIG. 5 is a cross sectional view, similar to FIG. 3, but showing still another modified compacter.
Figure 8:
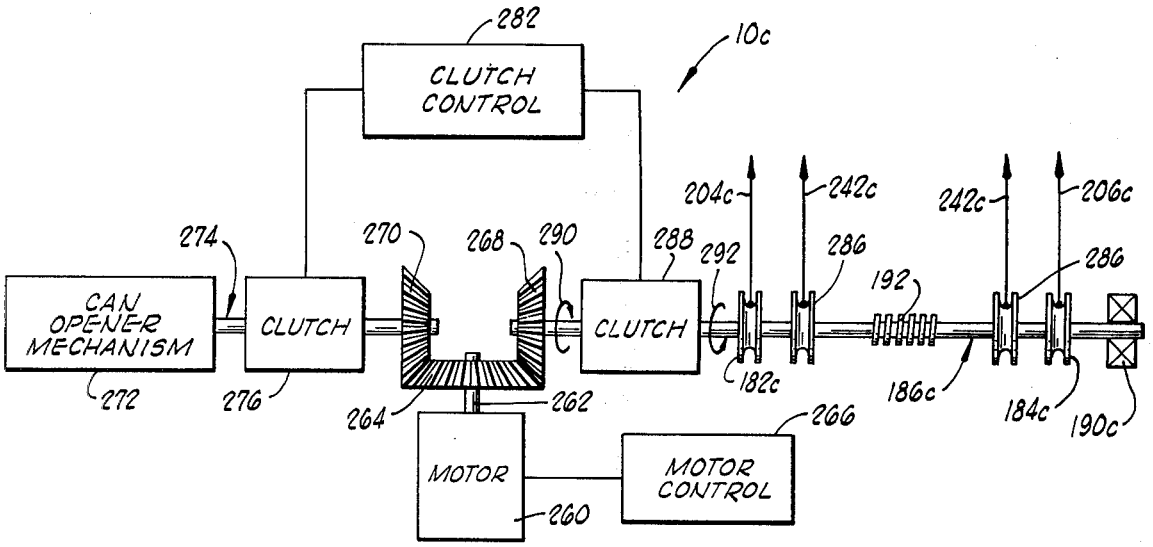

Shown in FIG. 5 is another modified compacter 10*b* which is constructed exactly like the compacter 10*a*, shown in FIGS. 3 and 4 and described in detail before, except the compacter 10*b* includes a pair of return springs 220*b*, one of the return springs 220*b* being disposed in the first slide channel 170 and the other return spring 220*b* being disposed in the second slide channel 174 (the last-mentioned return spring 220*b* in the second slide channel 174 not being shown in FIG. 5). Each of the return springs 220 biasingly engages the slide member 166 of the handle 76*a* and cooperates to bias the handle 76*a* in the return direction 72*a*.

The compacter 10*b* also includes a pair of fourth guide pulley wheels 230 rotatingly secured to a shaft 232 which is disposed in the chamber 126 and secured to the housing 18*a* generally above the upper gripping member 42*a* near the housing upper end 120. The fourth guide pulley wheels 230 are spaced a distance apart on the shaft 232 and one of the fourth guide pulley wheels 230 is generally aligned the guide pulley wheels 176, 182 and 194, the other fourth guide pulley wheel 230 being generally aligned with the guide pulley wheels 178, 184 and 196. It should be noted that only one of the fourth guide pulley wheels 230 is shown in FIG. 5 for the purpose of clarity.

The compacter 10*b* also includes a pair of return cables 242, only one of the return cables 242 being shown in FIG. 5. One end of each of the return cables 242 is connected to the slide member 166 of the handle 76*a* and the opposite end of each of the return cables 242 is connected to the slide bar 142 attached to the upper gripping member 42*a*. One of the return cables 242 (shown in FIG. 5) is disposed over the aligned pulley wheels 182, 176 and 230 and the other return cable 242 (not shown in FIG. 5) is disposed over the aligned pulley wheels 184, 178 and 230.

The compacter 10*b* will operate in a manner exactly like the compacter 10*a* except the handle 76*a* is moved in a compacting direction 74*a* against the biasing force of the return spring 220*b* and the return cables 242 each move in the cable compacting direction 246 allowing the upper gripping member 42*a* to be pulled in the compacting direction 74*a* via the cables 204 and 206. After the object has been compacted, the handle 76*a* is released and the return spring 220*b* biases the handle 76*a* in the return direction 72*a*. As the handle 76*a* is biased in the return direction 72*a*, the cables 204 and 206 are each pulled in the cable direction 208 in a manner described before, and the return cables 242 are each pulled in a cable direction 248 pulling the upper gripping member 42*a* in the return direction 72*a* to a start position.

EMBODIMENT OF FIG. 6

Schematically and diagramatically shown in FIG. 6 is another modified can compacter 10*c* and the compacter 10*c* is constructed and operates in a manner similar to that described before with respect to the compacter 10*b*, except the compacter 10*c* is constructed to be utilized in cooperation with a can opener mechanism such as a can opener mechanism of an existing can opener or modification thereof, for example, and the motor utilized to drive the existing can opener mechanism is also utilized to drive the compacter.

As diagramatically and schematically shown in FIG. 6, the compacter 10*c* includes a motor 260 having an output drive shaft 262 connected to a main drive gear 264, the motor 262 drivingly rotating the main drive gear 264 in an actuated on position thereof. The motor 260 is connected to a motor control 266 and the motor control 266 is constructed to position the motor 260 in the "on" position drivingly rotating the output drive shaft 262 in one position thereof and to position the motor 260 in the "off" position in one other position thereof. Motors and motor controls operated in a manner described before with respect to the motor 260 and the motor control 266 are well-known in the art and commercially available, a further description of the construction and operation of the motor 260 and the motor control 266 not being deemed necessary.

In one preferred form, the main drive gear 264 is constructed in the form of a bevel gear and a bevel type compacter drive gear 268 is gearingly connected to one portion of the main drive gear 264 and a bevel type can opener drive gear 270 is gearingly connected to one other portion of the main drive gear 264. The main drive gear 264 drivingly rotates the compacter drive gear 268 and the can opener drive gear 270 in an "on" position of the motor 260 drivingly rotating the main drive gear 264.

The can opener drive gear 270 is connected to a can opener mechanism 272 via a drive shaft 274, a clutch 276 being interposed in the drive shaft 274 between the can opener mechanism 272 and the can opener drive gear 270. The clutch 276 has an "engaged" position and a "dis-engaged" position and is constructed to mechanically connect the can opener mechanism 272 to the can opener drive gear 270 in the "engaged" position via the drive shaft 274, the can opener mechanism 272 being disconnected from the can opener drive gear 270 in the "disengaged" position of the clutch 276.

The clutch 276 is connected to a clutch control 282 and the clutch control 282 is constructed to position the clutch 276 in the "engaged" position in one position of the clutch control 282 and the position of clutch 276 in the "disengaged" position in one other position of the clutch control 282. The clutch 276 and the clutch control 282 may be mechanically connected in one preferred form or electrically connected in one other preferred form depending upon the various design and manufacturing considerations of a particular compacter application.

Clutches and clutch controls constructed for and operating in a manner similar to that described before with respect to the clutch 276 and the clutch control 282 are well-known in the art and commercially available. Further, can opener mechanisms constructed to automatically open cans by severing one end of the can in a manner allowing the severed end of the can to be removed are well-known in the art and commercially available.

As mentioned before the compacter 10*c* is constructed similar to the compacter 10*b*, one other difference being that the compacter 10*c* does not include a handle similar to the handle 76*a*, rather the moving of the upper gripping member 42*a* to a compacting position, the return of the upper gripping member 42*a* to the start position and the rotation of the lower gripping member 30*a* are each automatically accomplished in the compacter 10*c*. The shaft 186*c* is rotatingly supported in the chamber 126 of the housing 18*a* and the shaft 186*c* is connected to the compacter drive gear 268, the shaft 186*c* being rotatingly driven via the compacter drive gear 268 when connected thereto.

A clutch 288 is interposed in the shaft 186*c* and the clutch 288 has an "engaged" position and a "disengaged" position similar to the clutch 276, described before. The clutch 288 is mechanically or electrically connected to the clutch control 282, and the clutch control positions the clutch 288 in the "engaged" position in one position of the clutch control 282, the clutch control 282 positioning the clutch 288 in the "disengaged" position in one other position of the clutch control 282. The clutch control 282 is particularly constructed, in one preferred form, to position the clutch 276 in the "engaged" position and simultaneously position the clutch 288 in the "disengaged" position in one position of the clutch control 282, and to position the clutch 276 in the "disengaged" position and simultaneously position the clutch 288 in the "engaged" position in one other position of the clutch control 282.

Thus, the clutch control 282 is connected to the clutches 276 and 288 such that the drive shaft 274 connects the can opener drive gear 270 and the can opener mechanism 272 via the clutch 276 and the compacter drive gear 268 is disconnected from the shaft 186*c* in one position of the clutch control 282, and the can opener drive gear 270 is disconnected from the can opener mechanism 272 and the compacter drive gear 268 is drivingly connected to the shaft 186*c* in one other position of the clutch control 282. The can opener mechanism 272 is operated in a nonoperative position of the compacting mechanism, and the compacting mechanism of the presesnt invention is particularly constructed to be utilized in cooperation with an existing can opener mechanism with a minimum of modification, both being driven independently via the same driving force or motor., i.e. the motor 260, for example.

The guide pulley wheels 182*c* and 184*c* are each secured to the shaft 186*c* in a manner described before, and a pair of spaced guide pulley wheels 286 are also secured to the shaft 186*c*. One end of a cable 204*c* is secured to the guide pulley wheel 182*c*, one end of each of the return cables 242*c* is secured to one of the guide pulley wheels 286, and one end of the cable 206*c* is secured to the guide pulley wheel 184*c*.

The cable 204*c* is disposed over the guide pulley wheel 194 and the end of the cable 204*c*, opposite the end connected to the guide pulley wheel 182*c*, is connected to the slide bar 142. The cable 206*c* is disposed over the guide pulley wheel 196 and the end of the cable 206*c*, opposite the end connected to the guide pulley wheel 184*c*, is connected to the slide bar 142. Each of the return cables 286 is disposed over one of the guide pulley wheels 176 and 178 and over one of the guide pulley wheels 230, and the end of each return cable 286, opposite the end connected the guide pulley wheels 286, is secured to the slide bar 142. It should be noted that additional guide pulley wheels can be located on the shafts 180 and 232 to accommodate the return cables 286.

The guide pulley wheels 182*c*, 184*c* and 286 are each secured to the shaft 186*c* and each is constructed in the form of a reel for reeling in a cable connected thereto in one rotating direction of the shaft 186 and for releasing a cable therefrom in one other rotating direction of the shaft 186*c*. In a preferred form, the motor 262 is, more particularly, a reversable motor rotating the drive shaft 262 in one direction drivingly rotating the shaft 186*c* in compacting direction at rotation 290 via the main drive gear 264 and the compacter drive gear 268 and rotating the drive shaft 262 in a reverse direction drivingly rotating the shaft 186*c* in a return direction of rotation 292 via the main drive gear 264 and the compacter drive gear 268.

When the shaft 186*c* is driven in the direction of rotation 290, the cables 204*c* and 206*c* are each reeled about one of the guide pulley wheels 182*c* and 184*c* thereby pulling the upper gripping member 42*a* in the compacting direction. Further, when the shaft 186*c* is driven in the direction 290, the return cables 242*c* are each released from one of the guide pulley wheels 286 and 286 allowing the upper gripping member 42*a* to be moved or pulled in the compacting direction 74*a*. When the shaft 186*c* is driven in the opposite direction of rotation 292, the cables 204*c* and 206*c* are each released from one of the guide pulley wheels 182*c* and 184*c* and the return cables 242*c* are each reeled about one of the guide pulley wheels 286 thereby pulling the upper gripping member 42*a* in the return direction 72*a* to the start position.

A micro-switch or some other form of appropriate switch can be positioned in the chamber 126 of the compacter 10*c* engaging the upper gripping member 42*a* in the start position thereof and another switch can be positioned to engage the upper gripping member 42*a* in the compacting position thereof. The switches can be connected to the motor control 266 to position the motor 260 in the "off" position when either switch is engaged via a portion of the upper gripping member 42*a*. In this manner, the operation of the compacter 10*c* including the can opener mechanism 272 is essentially automatic and the manual controls for operating the clutch control 282 and the motor control 266 can be conveniently located on the compacter housing.

The compacters described herein thus provide a quick, convenient and economical apparatus for substantially flattening objects such as metal cans and the like. Further, the method of flattening or compacting objects described herein provides an efficient and economical method for compacting objects such as metal cans and the like. In either event, the securing of the object to be compacted in a substantially stationary position with respect to the upper and the lower gripping members while simultaneously rotating at least one of the gripping members to rotate or twist the object during the compacting stroke has been found to enhance and facilitate the compacting of the object.

Changes may be made in the construction of the various elements and assemblies of the compacters described herein and in the steps of the method of compacting objects as described herein without departing from the spirit and the scope of the invention as defined via the following claims.

What is claimed is:

1. A compacter for compacting objects such as metal cans and the like, comprising:

a housing having an upper end, a lower end, a chamber formed in a portion thereof, and a handle opening disposed near the upper end and intersecting a portion of the housing chamber;

a lower gripping member disposed in the housing chamber, having an upper face, a lower face, an outer periphery and a gripping surface formed in the upper face;

an upper gripping member disposed in the housing chamber, having an upper face, a lower face, an outer periphery and a gripping surface formed in the lower face, the gripping surface of the upper gripping member and the gripping surface of the lower gripping member each being grippingly engageable with a portion of the object to be compacted for securing an adjacent portion of the object to be compacted in a substantially stationary position relative to the upper gripping member and the lower gripping member in gripping engagement therewith during the compacting of the object to be compacted, the upper gripping member being spaced a predetermined distance from the lower gripping member in a start position for receiving the object to be compacted therebetween, the upper gripping member being slidingly disposed in the housing chamber and movable in a compacting direction toward the lower gripping member to a compacting position reducing the space between the upper gripping member and the lower gripping member and compacting the object to be compacted, and the upper gripping member being removable in a return direction away from the lower gripping member;

means having a portion connected to at least one of the gripping members rotating the gripping member connected thereto thereby rotating the object to be compacted in gripping engagement with the gripping members for facilitating the compacting thereof; and a handle having opposite ends, one end movably secured to a portion of the housing and a portion engageable with a portion of the upper gripping member, the end of the handle opposite the end movably secured to the housing extending through the handle opening, and the handle movable in one direction engaging a portion of the upper gripping member slidingly moving the upper gripping member in the compacting direction, the handle including:

a first handle member, having opposite, ends, one end being movably connected to the housing; and a second handle member, having opposite ends, one end hingedly connected to the end of the first handle member movably connected to the housing, the second handle member movable in one direction to a position extending in substantially the same plane as the first handle member and the first and the second handle members movable in one direction engaging a portion of the upper gripping member in this position at the first and the second handle members, and the second handle member movable in one other direction to a position generally adjacent the housing upper end.

2. A compacter for compacting objects such as metal cans and the like, comprising:

a housing having an upper end, a lower end and a chamber formed in a portion thereof;

a lower gripping member disposed in the housing chamber, having an upper face, a lower face and a gripping surface on the upper face;

an upper gripping member disposed in the housing chamber, having an upper face, a lower face and a gripping surface formed on the lower face, the gripping surface of the upper gripping member and the gripping surface of the lower gripping member each being grippingly engageable with a portion of the object to be compacted for securing an adjacent portion of the object to be compacted in a substantially stationary position relative to the upper gripping member and the lower gripping member in gripping engagement therewith during the compacting of the object to be compacted, the upper gripping member being spaced a distance from the lower gripping member in a start position for receiving the object to be compacted therebetween, at least one of the upoer gripping member and the lower gripping member being movably supported in the housing chamber for moving the upper and the lower gripping members to a compacting position reducing the space therebetween and compacting the object to be compacted; and means, having a portion connected to at least one of the upper gripping member and the lower gripping member, for rotating the one of the upper gripping member and the lower gripping member connected thereto during the initial movement of the one of the upper and the lower gripping members toward the compacting position, the upper gripping member and the lower gripping member each grippingly engaging the object to be compacted and the rotation by said means of the one of the upper gripping member and the lower gripping member twisting the object to be compacted for weakening the structural integrity of the object to be compacted.

3. The apparatus of claim 2 wherein the means rotating at least one of the upper and the lower gripping members is defined further as rotating the one of the upper and the lower gripping members connected thereto less than forty-five degrees during the initial movement of the upper and the lower gripping members toward the compacting position twisting the object to be compacted thereby weakening the structural integrity and facilitating the compacting thereof.

4. The apparatus of claim 2 wherein the upper gripping member and the lower gripping member are each defined further as including an outer periphery, and wherein the upper gripping member is slidingly disposed in the housing chamber movable in a compacting direction toward the lower gripping member and movable in a return direction away from the lower gripping member.

5. The apparatus of claim 4 wherein the upper gripping member includes:

a recess formed in the lower face thereof having a portion extending at an angle to the center line axis of the upper gripping member, the recess forming an annular, angularly extending wall in the upper gripping member, the gripping surface being formed on the annular wall for grippingly engaging objects having varying widths; and wherein the lower gripping member includes a recess formed in the upper face thereof having a portion extending at an angle to the center line axis of the lower gripping member, the recess forming an annular, angularly extending wall in the lower gripping member, the gripping surface being formed on the annular wall for grippingly engaging objects having varying widths.

6. The apparatus of claim 4 defined further to include:

a handle having opposite ends, one end moveably secured to a portion of the housing and a portion engageable with a portion of the upper gripping member, the handle moveable in one direction engaging a portion of the upper gripping member slidingly moving the upper gripping member in the compacting direction.

7. The apparatus of claim 6 wherein the handle includes an opening formed therethrough between the opposite ends thereof; and wherein the apparatus includes:

a rod having one end secured to the upper face of the upper gripping member and extending a distance therefrom, the end of the rod, opposite the end secured to the upper gripping member extending through the opening in the handle and an annular ledge formed on the rod engageable with a portion of the handle, a portion of the handle generally near the opening therethrough engaging the annular ledge moving the upper gripping member in the compacting direction in the one moving direction of the handle.

8. The apparatus of claim 6 defined further to include:

a return spring having opposite ends, one end of the return spring connected to the housing upper end and the opposite end of the return spring connected to the upper gripping member, the return spring biasing the upper gripping member in a return direction generally toward the start position; and a post disposed in the housing chamber, secured to the housing and having a stop surface engageable with a portion of the upper gripping member limiting the movement of the upper gripping member in the return direction and positioning the upper gripping member in the start position.

9. The apparatus of claim 4 wherein the housing includes a cam recess formed in a portion thereof and disposed in the housing chamber; the cam recess having a curved portion and as straight portion; and wherein the apparatus is defined further to include:

a cam projection connected to the upper gripping member and extending a distance therefrom, a portion of the cam projection being disposed in the cam recess and the cam projection following the cam recess during the movement of the upper gripping member in the compacting direction, the upper gripping member being rotated via the cam projection following the cam recess during the movement of the upper gripping member in the compacting direction.

10. The apparatus of claim 4 wherein the lower gripping member is defined further as being journally supported in the housing chamber and includes a bearing member connected to a portion thereof; and wherein the apparatus includes:

a drive gear journally supported in the housing chamber gearingly connected to the bearing member, the drive gear rotating the lower gripping member via the gearing connection between the drive gear and the bearing member in a drive position of the drive gear; and means connected to the drive gear rotatingly driving the drive gear in one position thereof thereby rotating the lower gripping member to facilitate the compacting of the object to be compacted.

11. The apparatus of claim 10 defined further to include:

a handle slidably connected to the housing;

cable means connected to the handle and to the upper gripping member, a portion of the cable means connected to the means rotatingly driving the drive gear, the upper gripping member being moved in the compacting direction and means rotatingly driving the drive gear being driven via the cable means during the sliding movement of the handle in one direction.

12. The apparatus of claim 11 wherein the housing includes a pair of channels formed in a portion thereof and disposed generally in the housing chamber; and wherein the apparatus includes:

a slide bar connected to the upper face of the upper gripping member, one end of the slide bar slidingly disposed in one of the pair of channels and the opposite end of the slide bar slidingly disposed in the other of the pair of channels, the sliding connection between the slide bar and the pair of channels maintaining the upper gripping member in a predetermined path of travel during the movement of the upper gripping member in the compacting direction.

13. The apparatus of claim 11 defined further to include:

return cable means connected to the handle and to the upper gripping member, the return cable means pulling the upper gripping member in the return direction, generally opposite the compacting direction, during the sliding movement of the handle in one direction.

14. The apparatus of claim 2 defined further to include:

a motor having an "on" position and an "off" position;

a motor control connected to the motor positioning the motor in the "on" position in one position of the motor control and positioning the motor in the "off" position in one other position of the motor control;

a main drive gear connected to the motor, the main drive gear being rotatingly driven in an "on" position at the motor;

a compacter drive gear gearingly connected to the main drive gear and being rotatingly driven via the main drive gear in a rotatingly driven position of the main drive gear, the compacter drive gear being connected to the means rotating one of the gripping members and the means rotating one of the upper and the lower gripping members rotating the one of the upper gripping member and the lower gripping member connected thereto when connected to the compacter drive gear and in a driven position of the compacter drive gear;

a clutch interposed between the compacter drive gear and the means rotating one of the upper and the lower gripping members, and connecting the compacter drive gear and the means rotating one of the upper and the lower gripping members in one position of the clutch;

a can opener drive gear gearingly connected to the main drive gear and being rotatingly driven via the main drive gear in a rotatingly driven position of the main drive gear;

a can opener mechanism driven via the can opener drive gear when connected thereto;

a clutch connected to the can opener drive gear and the can opener mechanism connecting the can opener drive gear and the can opener mechanism in one position of the clutch; and a clutch control connected to the first mentioned clutch and to the second mentioned clutch positioning the first mentioned clutch in an position connecting the compacter driven gear and the means rotating one of the upper and the lower gripping members in one position of the clutch control and positioning the second mentioned clutch in a position connecting the can opener drive gear and the can opener mechanism in one other position of the clutch control.

15. A method for compacting objects such as metal cans and the like between a pair of gripping members comprising the steps of:

spacing the gripping members a predetermined distance apart for receiving the object to be compacted therebetween;

placing the object between the two gripping members;

moving at least one of the gripping members toward the other gripping member into engagement with the object to be compacted;

holding the object to be compacted in a relatively stationary position with respect to each of the gripping members;

moving at least one of the gripping members toward the other gripping member thereby moving the gripping member toward a compacting position compacting the object between the two gripping members; and rotating at least one of the gripping members for twisting the object to be compacted as the gripping members are moved toward the compacting position, thereby rotating and weakening the structural integrity of the object to be compacted during the movement of the gripping members toward a compacting position.

16. A method for compacting objects such as metal cans and the like between a pair of gripping members comprising the steps of:

spacing the gripping members a predetermined distance apart for receiving the object to be compacted therebetween;

moving at least one of the gripping members toward the other gripping member into engagement with the object to be compacted;

hold the object to be compacted in a relatively stationary position with respect to each of the gripping members;

moving at least one of the gripping members toward the other gripping member thereby moving the gripping members toward a compacting position compacting the object between the two gripping members; and rotating at least one of the gripping members for twisting the object to be compacted as the gripping members are moved toward the compacting position, thereby rotating and weakening the structural integrity of the object to be compacted during the movement of the gripping members toward a compacting position.

* * * * *